US010928126B2

(12) United States Patent
Chung et al.

(10) Patent No.: US 10,928,126 B2
(45) **Date of Patent: *Feb. 23, 2021**

(54) REFRIGERATOR

(71) Applicant: LG ELECTRONICS INC., Seoul (KR)

(72) Inventors: Myungjin Chung, Seoul (KR); Kyungseok Kim, Seoul (KR); Kyeongyun Kim, Seoul (KR); Giseok Seong, Seoul (KR); Seunguk Ahn, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 123 days.

This patent is subject to a terminal disclaimer.

(21) Appl. No.: 16/238,808

(22) Filed: Jan. 3, 2019

(65) Prior Publication Data

US 2019/0212055 A1 Jul. 11, 2019

(30) Foreign Application Priority Data

Jan. 10, 2018 (KR) ..... 10-2018-0003516

(51) Int. Cl.

| | |
|---|---|
| ***F25B 29/00*** | (2006.01) |
| ***F25D 31/00*** | (2006.01) |
| ***F25D 17/06*** | (2006.01) |
| ***F25D 29/00*** | (2006.01) |
| ***F25B 5/02*** | (2006.01) |
| ***F25B 41/04*** | (2006.01) |
| *F25D 11/02* | (2006.01) |

(52) U.S. Cl.

CPC ..... *F25D 31/005* (2013.01); *F25B 5/02* (2013.01); *F25B 41/04* (2013.01); *F25D 17/06* (2013.01); *F25D 29/00* (2013.01); *F25D 31/007* (2013.01); *F25B 2341/066* (2013.01); *F25B 2600/2511* (2013.01); *F25D 11/022* (2013.01); *F25D 2331/803* (2013.01); *F25D 2400/02* (2013.01); *F25D 2600/02* (2013.01); *F25D 2600/06* (2013.01); *F25D 2700/12* (2013.01)

(58) Field of Classification Search

CPC ..... F25D 31/005; F25D 17/06; F25D 29/00; F25D 31/007; F25D 11/022; F25D 2331/803; F25D 2400/02; F25D 2600/02; F25D 2600/06; F25B 5/02; F25B 41/04; F25B 2341/066; F25B 2600/2511

USPC ..... 165/259

See application file for complete search history.

(56) References Cited

U.S. PATENT DOCUMENTS

2004/0254937 A1 12/2004 Gernold
2005/0236947 A1* 10/2005 LeClear ..... A47B 88/00 312/404
2019/0186803 A1* 6/2019 Seong ..... F25D 21/006

FOREIGN PATENT DOCUMENTS

CN 1942725 A 4/2007
CN 1967104 A 5/2007
(Continued)

OTHER PUBLICATIONS

Office Action of Chinese Patent Office in Appl'n No. 201910023654.9, dated Jul. 3, 2020.

*Primary Examiner* — Davis D Hwu
(74) *Attorney, Agent, or Firm* — Dentons US LLP

(57) ABSTRACT

A refrigerator includes a wine chamber, a wine chamber evaporator, a compressor, a wine chamber heater, a valve, a wine chamber temperature sensor, and a controller. The controller selectively performs a cooling mode and a heating mode.

20 Claims, 8 Drawing Sheets

(56) References Cited

FOREIGN PATENT DOCUMENTS

| | | | |
|---|---|---|---|
| CN | 102331135 | A | 1/2012 |
| DE | 19948119 | A1 | 4/2001 |
| EP | 1923648 | A2 | 10/2007 |
| JP | 2001201229 | A | 7/2001 |
| JP | 2001201230 | A | 7/2001 |
| JP | 2017207264 | A | 11/2017 |
| KR | 10-2018-0889966 | A | 3/2009 |

* cited by examiner

REFRIGERATOR

This application claims priority under 35 U.S.C. 119 and 365 to Korean Patent Application No. 10-2018-0003516, filed on Jan. 10, 2018 in the Korean Intellectual Property Office, the disclosure of which is incorporated herein by reference.

BACKGROUND

1. Field of the Disclosure

The present disclosure relates to a refrigerator, and to a refrigerator capable of controlling the temperature of a wine chamber using a wine chamber evaporator and a wine chamber heater.

2. Discussion of the Related Art

A refrigerator is a device for cooling or storing objects to be cooled (hereinafter, referred to as food), at a low temperature such as foods, from spoiling or going sour, and to preserve medicines and cosmetics.

The refrigerator includes a main body having at least one storage chamber formed therein and a freezing cycle device for cooling the storage chamber. The main body may include a plurality of storage chambers having different temperature ranges.

In recent years, refrigerators for storing foods, which need to be stored at a constant temperature, such as wine, have gradually increased. Korean patent registration No. 10-0889966 B1 (published on Mar. 24, 2009) discloses a wine refrigerator capable of refrigerating wine.

The wine refrigerator disclosed in Korean patent registration No. 10-0889966 B1 (published on Mar. 24, 2009) includes a wine storage space in which wine is received, a freezing system for cooling inside air of the wine storage space, a heater for partially heating the inside air of the wine storage space, an evaporator temperature sensor for measuring a temperature of the evaporator of the freezing system, and a controller for controlling operation of the freezing system and the heater. Since circulated air is generated in the wine refrigerator by the heater, an internal temperature of the wine refrigerator may be maintained in an optimal temperature range. In addition, in such a wine refrigerator, a first evaporator, a second evaporator and a third evaporator respectively perform evaporation in an upper, middle and lower layers of the wine storage space, thereby separately performing temperature control.

However, in the above-described wine refrigerator, since the heater is turned on while a compressor is driven, power consumption is large.

In the above-described wine refrigerator, if the internal temperature of the wine refrigerator is continuously increased by the heater for a long time, quality of wine may be lowered.

SUMMARY

An object of the present disclosure is to provide a refrigerator with a heating mode to heat a wine chamber.

An object of the present disclosure is to provide a refrigerator capable of preventing a wine chamber from being overheated.

An object of the present disclosure is to provide a refrigerator capable of preventing a wine chamber from being continuously heated for a long time to minimize quality deterioration of food stored in the wine chamber, such as wine.

To achieve the above objects, there is provided a refrigerator including a wine chamber evaporator configured to cool a wine chamber, a compressor connected with the wine chamber evaporator, a wine chamber heater configured to heat the wine chamber, a valve configured to regulate refrigerant flowing to the wine chamber evaporator, a wine chamber temperature sensor configured to sense a temperature of the wine chamber and a controller configured to control the compressor, the wine chamber heater and the valve.

The controller may selectively perform a cooling mode and a heating mode.

The cooling mode may be a mode in which the compressor is driven and the valve allows the refrigerant to flow to the wine chamber evaporator.

The heating mode may be a mode in which the wine chamber heater is turned on and the valve prevents the refrigerant from being supplied to the wine chamber evaporator.

The controller may start the cooling mode if a temperature sensed by the wine chamber is greater than a heating termination temperature which is higher than an upper-limit target temperature, after the heating mode starts.

The controller may start the cooling mode if a time when the temperature sensed by the wine chamber temperature sensor is greater than the upper-limit target temperature and is equal to or less than the heating termination temperature exceeds a heating setting time after the heating mode starts.

The refrigerator may further include a timer configured to count a time.

The timer may count the time when the heating mode starts. The controller may reset the timer when the heating mode starts, and the timer may start to count the time when the timer is reset.

The controller may reset the timer when the temperature sensed by the wine chamber temperature sensor is equal to or less than the upper-limit target temperature, in the heating mode.

The controller may start the cooling mode when the time counted in the timer exceeds the heating setting time.

The heating termination temperature may be higher than the upper target temperature by 1° C. to 2° C., and the heating setting time may be at least 20 minutes.

The controller may start the heating mode if the temperature sensed by the wine chamber temperature sensor is less than a cooling termination temperature which is lower than a lower-limit target temperature, after the cooling mode starts.

The controller may start the heating mode if a time when the temperature sensed by the wine chamber temperature sensor is less than the lower-limit target temperature and is equal to or greater than the cooling termination temperature exceeds a cooling setting time, after the cooling mode starts.

The timer may count the time when the cooling mode starts. The controller may reset the timer when the cooling mode starts, and the timer may start to count the time when the timer is reset.

The controller may reset the timer when the temperature sensed by the wine chamber temperature sensor is equal to or greater than the lower-limit target temperature, in the cooling mode.

The controller may start the heating mode when the time counted in the timer exceeds the cooling setting time.

The cooling termination temperature may be lower than the lower-limit target temperature by 2° C. to 3° C., and the cooling setting time may be at least 20 minutes.

A difference between the heating termination temperature and the upper-limit target temperature may be less than a difference between the lower-limit target temperature and the cooling termination temperature.

A refrigerator according to another aspect further includes a storage chamber evaporator configured to cool a storage chamber and a storage chamber temperature sensor configured to sense a temperature of the storage chamber. The compressor may be connected with the wine chamber evaporator and the storage chamber evaporator, the valve may regulate refrigerant flowing to the wine chamber evaporator and the storage chamber evaporator, and the controller may control the compressor, the wine chamber heater and the valve.

The controller may drive the compressor and control the valve to a storage chamber evaporator supply mode if the temperature sensed by the storage chamber temperature sensor is equal to or greater than a storage chamber upper-limit target temperature, in the heating mode.

The controller may turn off the compressor if the temperature sensed by the storage chamber temperature sensor is equal to or less than a storage chamber lower-limit target temperature in the heating mode.

DETAILED DESCRIPTION OF THE PREFERRED EMBODIMENTS

Hereinafter, detailed embodiments of the present disclosure will be described in detail with reference to the accompanying drawings.

Figure 1:
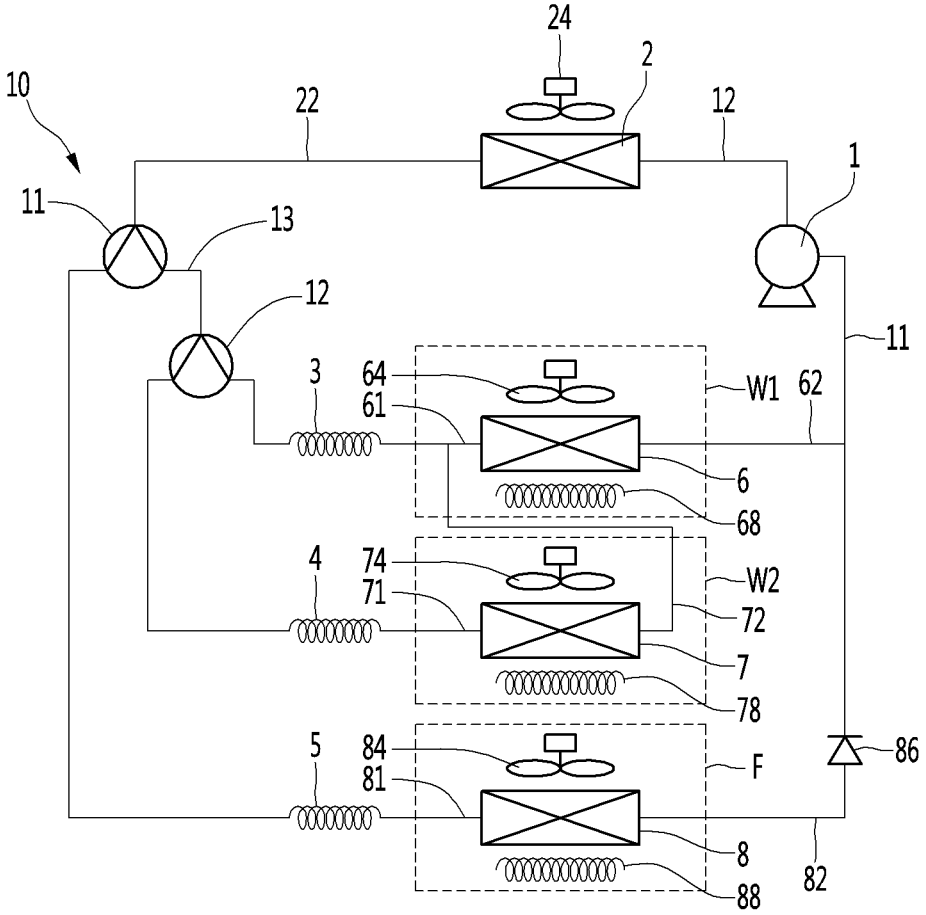
FIG. 1 is a diagram showing a configuration of a refrigerator according to an embodiment of the present disclosure.
Figure 2:
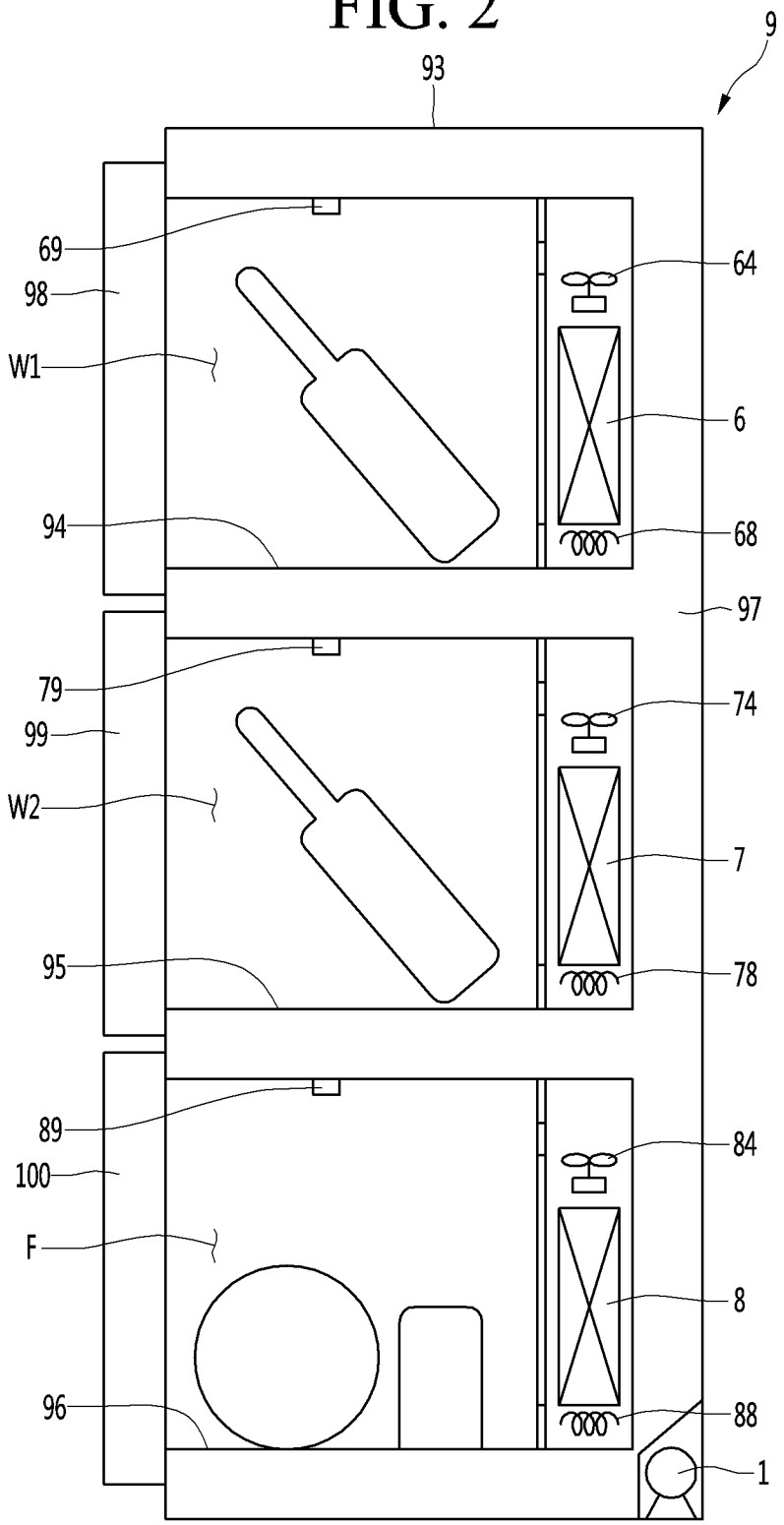
FIG. 2 is a cross-sectional view showing an inside of the refrigerator according to the embodiment of the present disclosure.
Figure 3:
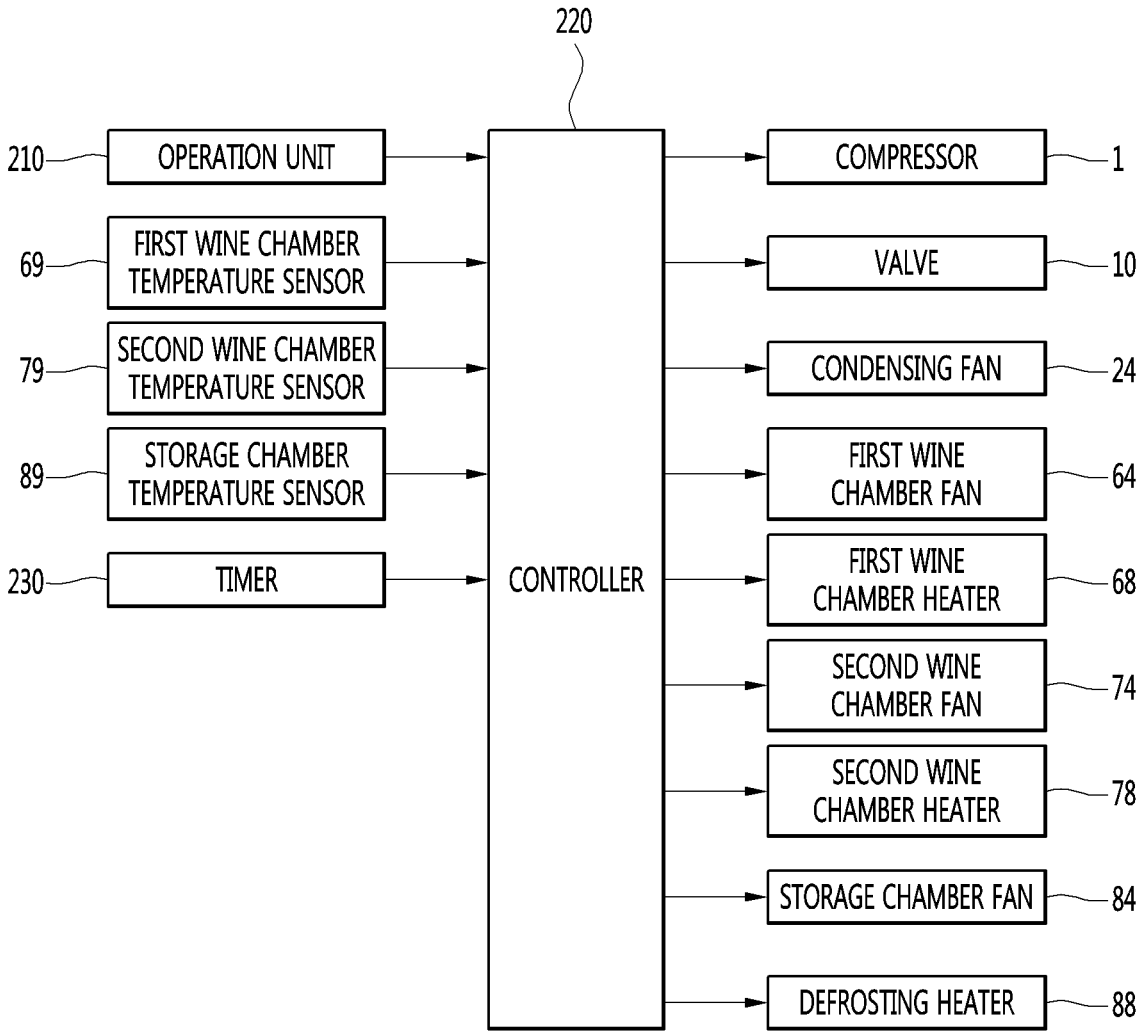
FIG. 3 is a control block diagram of the refrigerator according to the embodiment of the present disclosure.

FIG. 1 is a diagram showing a configuration of a refrigerator according to an embodiment of the present disclosure, FIG. 2 is a cross-sectional view showing an inside of the refrigerator according to the embodiment of the present disclosure, and FIG. 3 is a control block diagram of the refrigerator according to the embodiment of the present disclosure.

Figure 4:
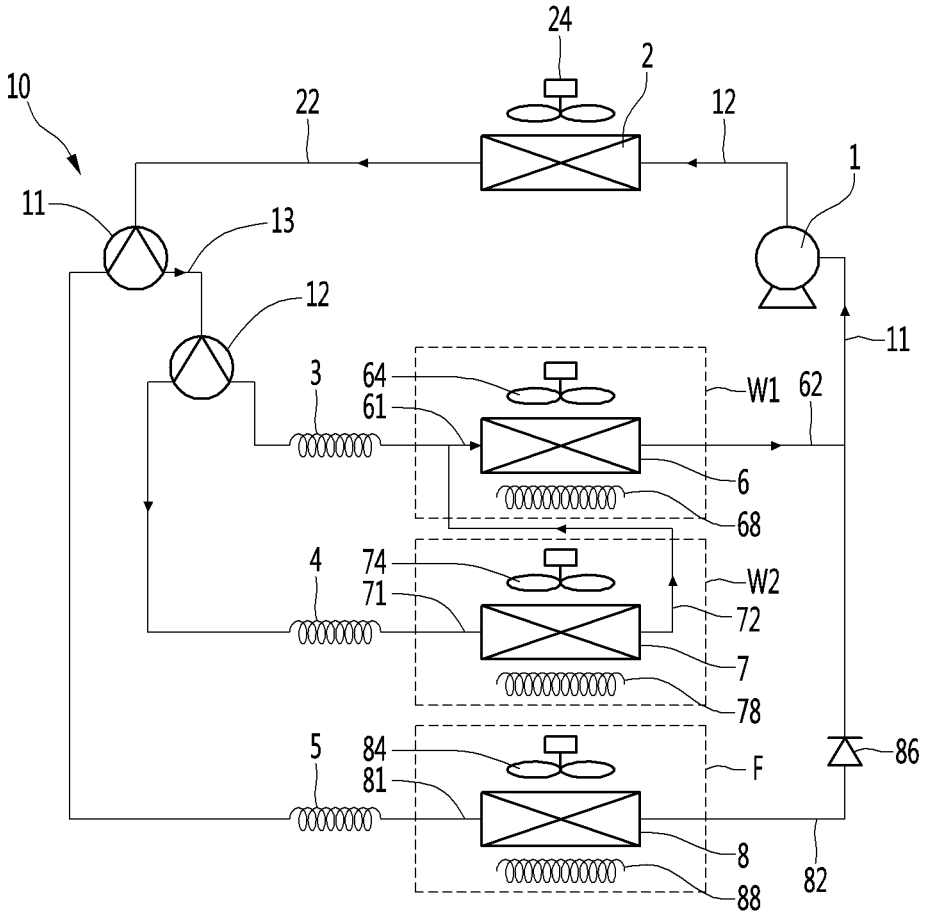
FIG. 4 is a view showing flow of refrigerant when a wine chamber of the refrigerator according to the embodiment of the present disclosure is in a cooling mode.
Figure 5:
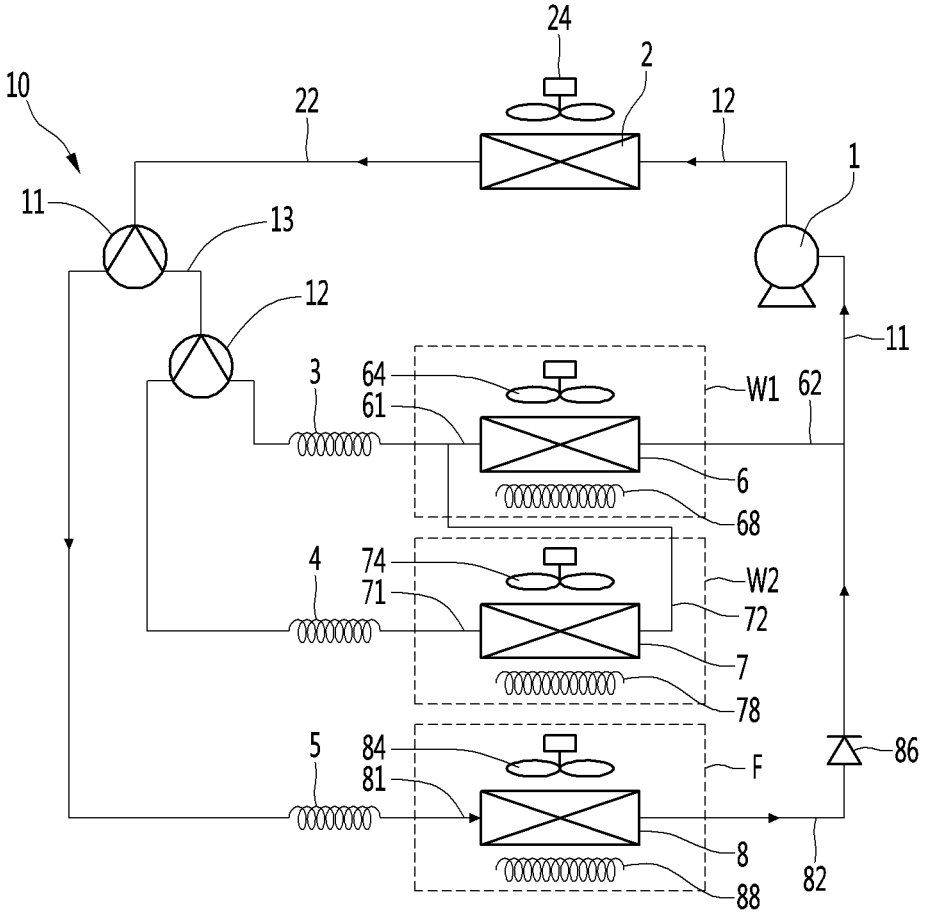
FIG. 5 is a view showing flow of refrigerant when a storage chamber of the refrigerator according to the embodiment of the present disclosure is in a cooling mode.

FIG. 4 is a view showing flow of refrigerant when a wine chamber of the refrigerator according to the embodiment of the present disclosure is in a cooling mode, and FIG. 5 is a view showing flow of refrigerant when a storage chamber of the refrigerator according to the embodiment of the present disclosure is in a cooling mode.

In the refrigerator of the present embodiment, at least one wine chamber W1 or W2 may be formed. The refrigerator includes a compressor 1, a condenser 2, at least one expansion device 3, or 4, at least one wine chamber evaporator 6 or 7, at least one wine chamber fan 64 or 74 and a controller 220. The controller may be an electronic circuit including a microprocessor, an electronic logical circuit, or a custom integrated circuit.

The refrigerator may be a wine-only refrigerator. In this case, the refrigerator may not have a storage chamber other than at least one wine chamber W1 or W2.

The refrigerator may include a main body 9 in which at least one wine chamber W1 or W2 are formed. The compressor 1, the condenser 2, at least one expansion device 3 or 4, at least one wine chamber evaporator 6 or 7, at least one wine chamber fan 64 or 74 and the controller 220 may be installed in the main body 9.

The refrigerator may store wind and food. The refrigerator may include the wine chambers W1 and W2 and a storage chamber F. The storage chamber F may be a space formed independently of the wine chambers W1 and W2.

If the refrigerator further includes the storage chamber F, the at least one wine chamber W1 or W2 and the storage chamber F may be partitioned in the main body 9.

If the refrigerator includes the wine chambers W1 and W2 and the storage chamber F, the refrigerator may further include a storage chamber evaporator 8, an expansion device 5, a valve 10, a storage chamber fan 84 and a defrosting heater 88. In this case, the compressor 1, the condenser 2, the expansion devices 3, 4, and 5, the wine chamber evaporators 6 and 7, the storage chamber evaporator 8, the valve 10, the wine chamber fans 64 and 74, the storage chamber fan 84, the defrosting heater 88 and the controller 220 may be installed in the main body 9.

The refrigerator may include one wine chamber W1 and one storage chamber F. In this case, the wine chamber W1 and the storage chamber F may be partitioned by a barrier.

The refrigerator may include a plurality of wine chambers W1 and W2 and one storage chamber F. In this case, the plurality of wine chambers W1 and W2 and the storage chamber F may be partitioned by a plurality of barriers. The refrigerator may include a storage chamber F and a pair of wine chambers W1 and W2, and one wine chamber of the pair of wine chambers W1 and W2 may be partitioned from the other wine chamber of the pair of wine chambers W1 and W2 by a first barrier. In addition, one wine chamber of the pair of wine chambers W1 and W2 may be partitioned from the storage chamber F by a second barrier.

The main body 9 may include an outer case 93 forming appearance thereof and wine chamber inner cases 94 and 95 in which the wine chambers W1 and W2 are formed. If the main body 9 includes the pair of wine chambers W1 and W2, the wine chamber inner case may include a first wine chamber inner case 94, in which the first wine chamber W1 is formed, and a second wine chamber inner case 95, in which the second wine chamber W2 is formed.

If the storage chamber F is formed in the main body 9, the main body 9 may further include a storage chamber inner case 96.

In addition, the main body 9 may include an insulator 97 for insulating the inside of the refrigerator. The insulator 97 may be disposed between the wine chamber inner case and the outer case 93. If the main body 9 further includes the storage chamber inner case 96, the insulator 97 may be disposed between the storage chamber inner case 96 and the outer case 93 and between the wine chamber inner case and the storage chamber inner case 96. If the main body 9 includes the pair of wine chamber inner cases 94 and 95, the second wine chamber inner case 95 may be located between the first wine chamber inner case 94 and the storage chamber inner case 96. In addition, the insulator 97 may be disposed between the first wine chamber inner case 94 and the second wine chamber inner case 95.

The main body 9 may include a door for opening or closing the wine chambers W1 and W2 and a door for opening or closing the storage chamber F. If the pair of wine chambers W1 and W2 are formed in the main body 9, the main body 9 may include a first wine chamber door 98 for opening or closing the first wine chamber W1 and a second wine chamber door 99 for opening or closing the second wine chamber W2. If the storage chamber F is further formed in the main body 9, the main body 9 may include a storage chamber door 100 for opening or closing the storage chamber F.

The wine chambers W1 and W2 may be wine-only storage chambers capable of refrigerating red wine or white wine. The wine chambers W1 and W2 may be cooled in a temperature range capable of storing wine with optimal quality.

If the refrigerator includes the pair of wine chambers W1 and W2, the first wine chamber W1 may be a red wine chamber capable of refrigerating red wine and the second wine chamber W2 may be a switchable wine chamber capable of selectively refrigerating red wine or white wine.

If the refrigerator further includes the storage chamber F, the storage chamber F may be a low-temperature storage chamber having a lower temperature range than the wine chambers W1 and W2 and, particularly, the first wine chamber W1 or the second wine chamber W2.

The first wine chamber W1 and the second wine chamber W2 may have the same or similar temperature ranges, and may be the same in the other configurations other than the temperature range. Hereinafter, the wine chambers W1 and W2 will be described with respect to the common configurations of the first wine chamber W1 and the second wine chamber W2, and the first wine chamber W1 and the second wine chamber W2 will be respectively described with reference to different configurations of the first wine chamber W1 and the second wine chamber W2. The present invention is not limited to the refrigerator including a pair of wine chambers W1 and W2, and the refrigerator may include one wine chamber and one storage chamber F.

The first wine chamber W1 may have a fixed temperature range. A temperature range of the first wine chamber W1 may be variable, and a user may select a specific temperature in the temperature range of the first wine chamber W1 as a desired temperature.

The temperature range of the first wine chamber W1 may be, for example, set to 10° C. to 20° C. and the temperature range of red wine may be, for example, set to 12° C. to 18° C.

The user may input the target temperature of the first wine chamber W1 through an operation unit 210, and the target temperature of the first wine chamber W1 may be a specific temperature selected by the user in the red wine temperature range of 12° C. to 18° C.

The second wine chamber W2 may be a wine chamber in which one of a plurality of temperature ranges may be selected by the user.

The temperature range of the second wine chamber W2 may be set higher than that of the storage chamber F. In addition, the temperature range of the second wine chamber W2 may be equal to that of the first wine chamber W1 or may be lower than that of the first wine chamber W1.

The temperature range of the second wine chamber W2 may be, for example, set to 10° C. to 20° C. and the temperature range of red wine may be, for example, 12° C. to 18° C.

In another example, the temperature range of the second wine chamber W2 may be set to 4° C. to 13° C. and the temperature range of white wine may be, for example, 6° C. to 11° C.

The refrigerator includes the operation unit 210 capable of selecting the temperature range of the second wine chamber W2. The user may manipulate the operation unit 210 to select the temperature range of the second wine chamber W2 equal to that of the first wine chamber W1 or the temperature range of the second wine chamber W2 lower than that of the first wine chamber W1.

The user may select the second wine chamber W2 as a red wine mode through the operation unit 210. In this case, the second wine chamber W2 may be a red wine chamber cooled to the temperature range of red wine, for example, 12° C. to 18° C.

The user may select the second wine chamber W2 as a white wine mode through the operation unit 210. In this case, the second wine chamber W2 may be a white wine chamber cooled to the temperature range of white wine, for example, 6° C. to 11° C.

The user may input the target temperature of the second wine chamber W2 through the operation unit 210. In this case, the target temperature of the second wine chamber W2 may be a specific temperature selected by the user in the red wine temperature range of 12° C. to 18° C. or a specific temperature selected by the user in the white wine temperature range of 6° C. to 11° C.

The storage chamber F may be a normal cooling chamber (or a non-wine chamber) having a lower temperature range than the wine chambers W1 and W2.

The storage chamber F may be configured such that the temperature range thereof is selectable, and may include a switchable chamber (a temperature changable chamber) in which one of a plurality of temperature ranges may be selected.

The user may manipulate the operation unit 210 to set the storage chamber F to a refrigerating chamber mode. In this case, the temperature range of the storage chamber F may be set to 0° C. to 7° C. which is a refrigerating chamber temperature range. In addition, the user may input a desired refrigerating temperature using the operation unit 210, and the target temperature of the storage chamber F may be a specific temperature selected by the user in a range from 0° C. to 7° C.

The user may manipulate the operation unit 210 to set the storage chamber F to a freezing chamber mode. In this case, the temperature range of the storage chamber F may be set to −24° C. to −16° C. which is a freezing chamber temperature range. In addition, the user may input a desired freezing temperature using the operation unit 210, and the target temperature of the storage chamber F may be a specific temperature selected by the user in a range from −24° C. to −16° C.

The user may manipulate the operation unit 210 to set the storage chamber F to a special mode (e.g., kimchi storage mode). In this case, the temperature range of the storage chamber F may be set to −2° C. to 0° C. which is a special mode temperature range. In addition, the user may input a desired storage compartment temperature using the operation unit 210, and the target temperature of the storage chamber F may be a specific temperature selected by the user in a range from −2° C. to 0° C.

The maximum target temperature of the storage chamber F may be lower than the maximum target temperatures of the wine chambers W1 and W2. In this case, the maximum target temperature of the storage chamber F may be lower than the maximum target temperature of the first wine chamber W1 or the maximum target temperature of the second wine chamber W2.

The wine chambers W1 and W2 store food which needs to be stored at a constant temperature (that is, wine), and thus the maximum target temperatures thereof are high. The storage chamber F stores food with lower storage temperature than white wine or red wine, and thus the maximum target temperature thereof is low.

For example, the temperature range of the storage chamber F may be −24° C. to −16° C., the temperature range of the first wine chamber W1 may be 12° C. to 18° C., and the temperature range of the second wine chamber W2 may be 6° C. to 11° C. In this case, −16° C. which is the maximum target temperature of the storage chamber F is lower than 18° C. which is the maximum target temperature of the first wine chamber W1 and 11° C. which is the maximum target temperature of the second wine chamber W2.

The wine chambers W1 and W2 may be cooled or heated based on the target temperatures thereof. Since the wine chambers W1 and W2 store food which needs to be stored at a constant temperature (that is, wine, etc.), the temperatures thereof need to be prevented from being excessively increased or decreased.

The temperatures of wine chambers W1 and W2 need to be maintained with a relatively small temperature change width and need to be maintained at the constant temperatures by a cooling mode using the wine chamber evaporators 6 and 7 and a heating mode using the wine chamber heaters 68 and 78.

The controller 220 may selectively perform the cooling mode for cooling the wine chambers W1 and W2 and the heating mode for heating the wine chambers W1 and W2. The wine chambers W1 and W2 may be switched to the heating mode while being cooled by the cooling mode, thereby being heated. In contrast, the wine chambers W1 and W2 may be switched to the cooling mode while being heated by the heating mode, thereby being cooled.

If the temperatures of the wine chambers W1 and W2 are excessively increased while the wine chambers W1 and W2 are heated by the heating mode, the wine chambers W1 and W2 may be switched to the cooling mode, thereby being cooled. Although the temperatures of the wine chambers W1 and W2 are not excessively increased while the wine chambers W1 and W2 are heated by the heating mode, if a relatively high temperature range is maintained for a long time, the wine chambers W1 and W2 may be switched to the cooling mode, thereby being cooled.

If the temperatures of the wine chambers W1 and W2 are excessively decreased while the wine chambers W1 and W2 are cooled by the cooling mode, the wine chambers W1 and W2 may be switched to the heating mode, thereby being heated. Although the temperatures of the wine chambers W1 and W2 are not excessively decreased while the wine chambers W1 and W2 are cooled by the cooling mode, if a relatively low temperature range is maintained for a long time, the wine chambers W1 and W2 may be switched to the heating mode, thereby being heated.

The cooling mode and heating mode of the wine chamber and switching of the mode will be described below.

The storage chamber F may or may not be cooled to the storage chamber target temperature. The storage chamber F may store food having a lower storage temperature than white wine or red wine, and the temperature thereof may be controlled to have a larger temperature change range than the wine chamber, such that the storage chamber F is sufficiently cooled.

The upper-limit target temperature of the storage chamber F may be higher than the target temperature of the storage chamber F by 1° C. or 1.5° C., and the lower-limit target temperature of the storage chamber F may be lower than the target temperature of the storage chamber F by 1° C. or 1.5° C.

Meanwhile, the second wine chamber W2 may be located between the first wine chamber W1 and the storage chamber F. The first wine chamber W1 may configure an upper chamber located above the second wine chamber W2, the storage chamber F may configure a lower chamber located below the second wine chamber W2, and the second wine chamber W2 may configure a middle chamber located between the first wine chamber W1 and the storage chamber F.

In this case, the second wine chamber W2 for selectively refrigerating white wine or red wine may be located between the storage chamber F and the first wine chamber W1.

The compressor 1 may compress refrigerant and may be connected to the wine chamber evaporators 6 and 7.

The compressor 1 may be connected to a compressor suction path 11 and a compressor discharge path 12. The compressor 1 may suck and compress the refrigerant of the compressor suction path 11 and then discharge the refrigerant to the compressor discharge path 12.

The compressor suction path 11 may be connected to the wine chamber evaporators 6 and 7. If the refrigerator further includes a storage chamber evaporator 8, the compressor suction path 11 may be connected to the wine chamber evaporators 6 and 7 and the storage chamber evaporator 8.

The condenser 2 may be connected to the compressor discharge path 12. The condenser 2 may be connected with a condenser outlet path 22. Refrigerant compressed in the compressor 1 and then discharged through the compressor discharge path 12 may be introduced into the condenser 2, condensed while passing through the condenser 2, and discharged through the condenser outlet path 22.

The refrigerator may further include a condensing fan 24 for blowing outside air to the condenser 2.

The expansion devices 3, 4 and 5 may decompress and expand the refrigerant flowing to the wine chamber evaporators 6 and 7 or the storage compartment evaporator 8 after being condensed in the condenser 2. The expansion devices 3, 4 and 5 may be capillary tubes or electronic expansion valves.

The plurality of expansion devices 3, 4 and 5 may include wine chamber expansion devices 3 and 4 for decompressing the refrigerant flowing toward the wine chamber evaporators 6 and 7, and the storage chamber expansion device 5 installed in a storage chamber evaporator inlet path 81 to decompress the refrigerant flowing toward the storage chamber evaporator 8.

The wine chamber evaporators 6 and 7 may cool the wine chambers W1 and W2.

The plurality of wine chamber evaporators 6 and 7 may be provided in the main body 9, and the plurality of wine chamber evaporators 6 and 7 may include a first wine chamber evaporator 6 for cooling the first wine chamber W1 and a second wine chamber evaporator 7 for cooling the second wine chamber W2.

If the wine chamber evaporators 6 and 7 include the first wine chamber evaporator 6 and the second wine chamber evaporator 7, the wine chamber expansion devices 3 and 4 may include a first wine chamber expansion device 3 installed in a first wine chamber evaporator inlet path 61 to decompress the refrigerant flowing toward the first wine chamber evaporator 6 and a second wine chamber expansion device 4 installed in a second wine chamber evaporator inlet path 71 to decompress the refrigerant flowing toward the second wine chamber evaporator 7.

The first wine chamber evaporator 6 and the second wine chamber evaporator 7 may be connected in series and the first wine chamber evaporator 6 and the second wine chamber evaporator 7 connected in series may be connected to the storage chamber evaporator 8 in parallel.

The first wine chamber evaporator 6 may be connected with the first wine chamber evaporator inlet path 61 and a first wine chamber evaporator outlet path 62 and may cool the first wine chamber W1. The first wine chamber evaporator outlet path 62 may be connected to the compressor suction path 11. One end of the first wine chamber evaporator outlet path 62 may be connected to the first wine chamber evaporator 6, and an other end of the first wine chamber evaporator outlet path 62 may be connected between a one-way valve 86, which will be described below, and the compressor 1 in the flow direction of the refrigerant passing through the storage chamber evaporator 8.

The refrigerant passing through the first wine chamber evaporator 6 may be sucked into the compressor 1 through the first wine chamber evaporator outlet path 62 and the compressor suction path 11.

The refrigerator may include a first wine chamber fan 64 for circulating the cool air of the first wine chamber W1 to the first wine chamber evaporator 6 and the first wine chamber W1.

The second wine chamber evaporator 7 may be connected with the second wine chamber evaporator inlet path 71 and a second wine chamber evaporator outlet path 72 and may cool the second wine chamber W2.

The second wine chamber evaporator outlet path 72 may be connected to the first wine chamber evaporator inlet path 61. The second wine chamber evaporator outlet path 72 may be connected to the first wine chamber evaporator inlet path 61 between the first wine chamber expansion device 3 and the first wine chamber evaporator 6. In this case, the second wine chamber evaporator 7 may be connected to the first wine chamber evaporator 6 in series, and the refrigerant may flow to the second wine chamber evaporator 7, the second wine evaporator outlet path 72, the first wine chamber evaporator inlet path 61, the first wine chamber evaporator 6, and the first wine chamber evaporator outlet path 62.

The refrigerator may include a second wine chamber fan 74 for circulating the cool air of the second wine chamber W2 to the second wine chamber evaporator 7 and the second wine chamber W2.

The storage chamber evaporator 8 may be disposed in the storage chamber F to cool the storage chamber F. The storage chamber evaporator 8 may be connected with the storage chamber evaporator inlet path 81 and a storage chamber evaporator outlet path 82 and may cool the storage chamber F. The storage chamber evaporator outlet path 82 may be connected to the compressor suction path 11. The refrigerant passing through the storage chamber evaporator 8 may be sucked into the compressor through the storage chamber evaporator outlet path 82 and the compressor suction path 11.

In the storage chamber evaporator outlet path 82, the one-way valve 86 for preventing the refrigerant from flowing back to the storage chamber evaporator 8 may be provided. The one-way valve 86 may be a check valve for allowing the refrigerant of the storage chamber evaporator 3 to be sucked into the compressor 1. The refrigerator may cool the first wine chamber W1 and the second wine chamber W2 or the first wine chamber W1 after cooling the storage chamber F alone. Since the first evaporator 6 has relatively higher pressure than the third evaporator 8, the refrigerant passing through the first wine chamber evaporator 6 may flow to the storage chamber evaporator 8 having relatively low pressure. However, if the one-way valve 86 is installed in the storage chamber evaporator outlet path 82, the refrigerant passing through the first wine chamber evaporator outlet path 62 is prevented from flowing to the storage chamber evaporator 8.

The refrigerator may include a storage chamber fan 84 for circulating the cool air of the storage chamber F to the storage chamber evaporator 8 and the storage chamber F.

Meanwhile, the refrigerator may include wine chamber heaters 68 and 78 disposed in the wine chambers W1 and W2 to heat the wine chambers W1 and W2.

If the refrigerator includes the plurality of wine chambers W1 and W2, the wine chamber heaters 68 and 78 may be provided in the wine chambers W1 and W2, respectively.

In the first wine chamber W1, the first wine chamber heater 68 for heating the first wine chamber W1 may be disposed. The first wine chamber heater 68 may be turned on while the compressor 1 is stopped, and when the first wine chamber fan 64 is driven, the first wine chamber fan 64 may circulate the cool air of the first wine chamber W1 to the first wine chamber heater 68 and the first wine chamber W1 to heat the first wine chamber W1.

In the second wine chamber W2, the second wine chamber heater 78 to heat the second wine chamber W2 may be disposed. The second wine chamber heater 78 may be turned on while the compressor 1 is stopped, and when the second wine chamber fan 74 is driven, the second wine chamber 74 may circulate the cool air of the second wine chamber W2 to the second wine chamber heater 78 and the second wine chamber W2 to heat the second wine chamber W2.

Meanwhile, the refrigerator may include the defrosting heater 88 for defrosting the storage chamber evaporator 8. The defrosting heater 88 may be disposed around the storage chamber evaporator 8 to defrost the storage chamber evaporator 8.

The defrosting heater 88 may be turned on while the compressor 1 is stopped, and when the storage chamber fan 84 is driven, the storage chamber fan 84 may circulate the cool air of the storage chamber F to the defrosting heater 88, the storage chamber evaporator 8 and the storage chamber F to heat the storage chamber evaporator 8 and to defrost the storage chamber evaporator 8.

The valve 10 may regulate the refrigerant flowing to the wine chamber evaporators 6 and 7. If the refrigerator further includes the storage chamber evaporator 8, the valve 10 may regulate the refrigerant flowing to the wine chamber evaporators 6 and 7 and the storage chamber evaporator 8.

The valve 10 may be connected with the condenser outlet path 22. The valve 10 may be connected with the wine chamber evaporator inlet paths 61 and 71. If the refrigerator further includes the storage chamber evaporator 8, the valve 10 may be connected with the wine chamber evaporator inlet paths 61 and 71, and the storage chamber evaporator inlet path 81.

If the refrigerator includes the first wine chamber evaporator 6 and the second wine chamber evaporator 7, the valve 10 may be connected with the first wine chamber evaporator inlet path 61, the second wine chamber evaporator inlet path 71 and the storage chamber evaporator inlet path 81.

The valve 10 may be composed of a single valve and the valve 10 may be composed of a four-way valve connected to the condenser outlet path 22, the first wine chamber evaporator inlet path 61, the second wine chamber evaporator inlet path 71 and the storage chamber evaporator inlet path 81.

The valve 10 may be composed of a combination of a plurality of valves and the valve 10 may include a first three-way valve 11 connected with the condenser outlet path 22 and the storage chamber evaporator inlet path 81, a second three-way valve 12 connected with the first wine chamber evaporator inlet path 61 and the second wine chamber evaporator inlet path 71, and a three-way valve connection path 13 connecting the first three-way valve 11 with the second three-way valve 12.

The valve 10 may operate in a wine chamber evaporator supply mode for guiding the refrigerant condensed in the condenser 2 to the wine chamber evaporators 6 and 7 as shown in FIG. 4 or may operate in a storage chamber evaporator supply mode for guiding the refrigerant condensed in the condenser 2 to the storage chamber evaporator 8 as shown in FIG. 5.

The valve 10 may prevent the refrigerant from being supplied to the storage chamber evaporator 8, in the wine chamber evaporator supply mode.

If the refrigerator includes the first wine chamber evaporator 6 and the second wine chamber evaporator 7, the wine chamber evaporator supply mode may be a second wine chamber supply mode for guiding the refrigerant to the second wine chamber evaporator 7 or a first wine chamber supply mode for guiding the refrigerant to the first wine chamber evaporator 6.

The valve 10 may prevent the refrigerant from being supplied to the wine chamber evaporators 6 and 7, in the storage chamber evaporator supply mode.

The refrigerator may be a cycle in which the second wine chamber evaporator 7 and the first wine chamber evaporator 6 may be connected in series, the refrigerant may bypass the second wine chamber evaporator 7 and flow to the first wine chamber evaporator 6, and the first wine chamber evaporator 6 and the second wine chamber evaporator 7 connected in series may be connected to the storage chamber evaporator 8 in parallel.

In the wine chamber evaporator supply mode and, more particularly, in the first wine chamber supply mode, the refrigerant may be sucked into the compressor 1 after sequentially passing through the compressor 1, the condenser 2, the valve 10, the first wine chamber expansion device 3 and the first wine chamber evaporator 6.

In the wine chamber evaporator supply mode and, more particularly, in the second wine chamber supply mode, the refrigerant may be sucked into the compressor 1 after sequentially passing through the compressor 1, the condenser 2, the valve 10, the second wine chamber expansion device 4, the second wine chamber evaporator 7 and the first wine chamber evaporator 6.

In the storage chamber evaporator supply mode, the refrigerant may be sucked into the compressor 1 after sequentially passing through the compressor 1, the condenser 2, the valve 10, the storage chamber expansion device 5 and the storage chamber evaporator 8.

The refrigerator may include wine chamber temperature sensors 69 and 79 disposed in the wine chambers W1 and W2 to sense the temperatures of the wine chambers W1 and W2.

If the refrigerator includes a pair of wine chambers W1 and W2, the wine chamber temperature sensors 69 and 79 may be provided in the wine chambers W1 and W2, respectively. In this case, the first wine chamber temperature sensor 69 for sensing the temperature of the first wine chamber may be disposed in the first wine chamber W1, and the second wine chamber temperature sensor 79 for sensing the temperature of the second wine chamber may be disposed in the second wine chamber W2.

The controller 220 (see FIG. 3) may control the compressor 1 and the wine chamber heaters 68 and 78 in order to control the temperatures of the wine chambers W1 and W2. In addition, the controller 220 may control the valve 10 in order to control the temperatures of the wine chambers W1 and W2. The controller 220 may control the wine chamber fans 64 and 74 when controlling the temperatures of the wine chambers W1 and W2.

The controller 220 may perform a cooling mode in which the compressor 1 is driven, the wine chamber heaters 68 and 78 are turned off, and the valve 10 allows the refrigerant to flow to the wine chamber evaporators 6 and 7, thereby cooling the wine chambers W1 and W2. In the cooling mode, the controller 220 may drive the wine chamber fans 64 and 74.

The controller 220 may perform a heating mode in which the compressor 1 is not driven, the wine chamber heaters 68 and 78 are turned on, and the valve 10 prevents the refrigerant from being supplied to the wine chamber evaporators 6 and 7, thereby heating the wine chambers W1 and W2. In the heating mode, the controller 220 may drive the wine chamber fans 64 and 74.

The controller 220 may selectively perform the cooling mode and the heating mode. The controller 220 may not perform the heating mode in the cooling mode and may not perform the cooling mode in the heating mode. The controller 220 may alternately perform the cooling mode and the heating mode.

The refrigerator may further include a storage chamber temperature sensor 89 disposed in the storage chamber F to sense the temperature of the storage chamber F.

The controller 220 may control the compressor 1, the storage chamber fan 84 and the valve 10 in order to control the temperature of the storage chamber F. In addition, the controller 220 may control the defrosting heater 88 in order to defrost the storage chamber evaporator 8.

Figure 6:
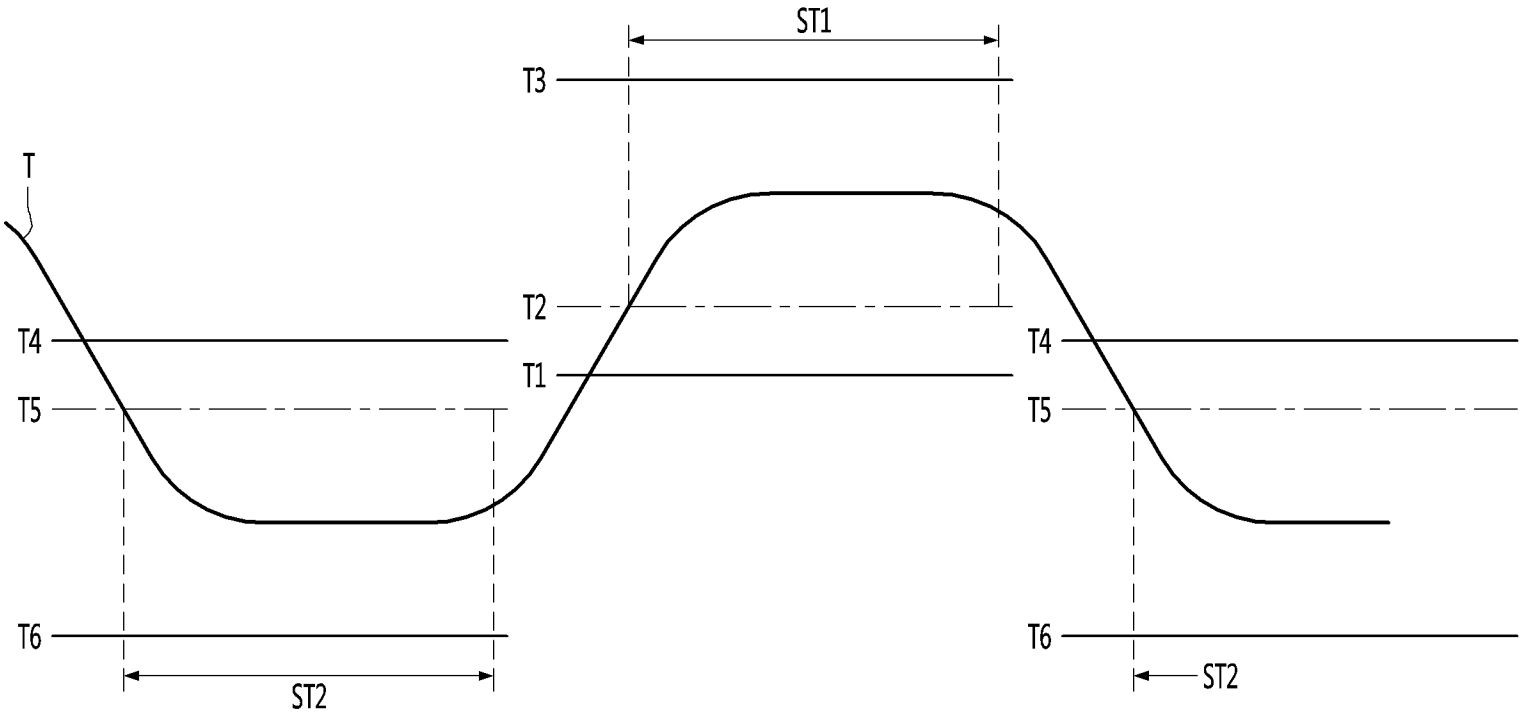
FIG. 6 is a view showing switching between a heating operation and a cooling operation according to change in temperature of the wine chamber of the refrigerator according to the embodiment of the present disclosure.
Figure 8:
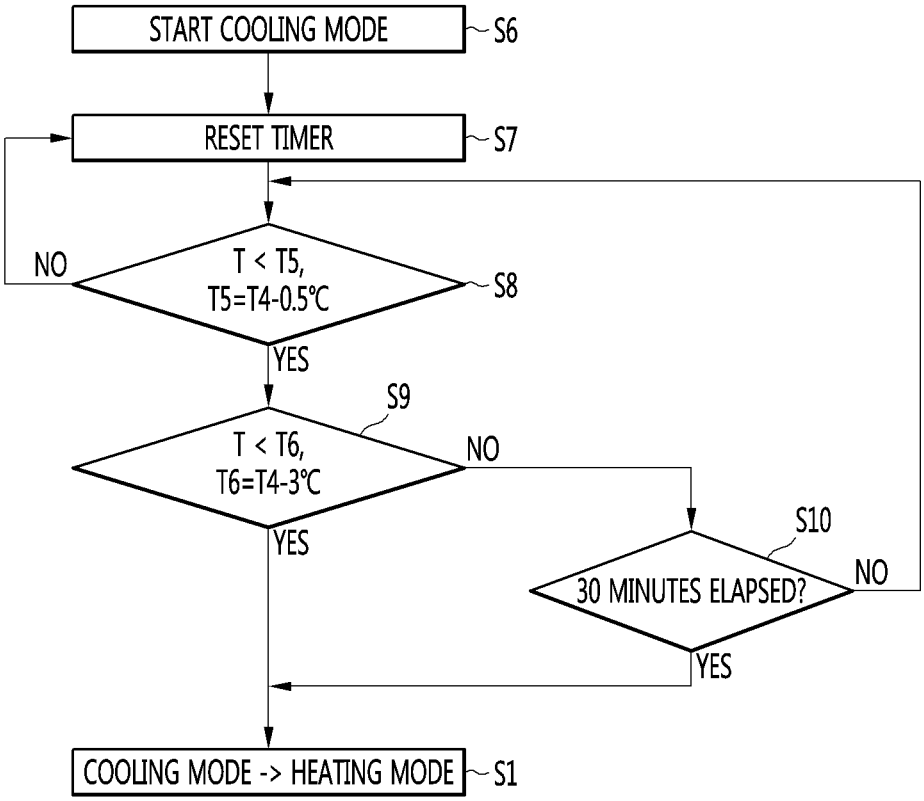
FIG. 8 is a flowchart illustrating a process of switching the wine chamber of the refrigerator according to the embodiment of the present disclosure from a cooling mode to a heating mode.

FIG. 6 is a view showing switching between a heating operation and a cooling operation according to change in temperature of the wine chamber of the refrigerator according to the embodiment of the present disclosure, FIG. is a flowchart illustrating a process of switching the wine chamber of the refrigerator according to the embodiment of the present disclosure from a heating mode to a cooling mode, and FIG. 8 is a flowchart illustrating a process of switching the wine chamber of the refrigerator according to the embodiment of the present disclosure from a cooling mode to a heating mode.

The controller 220 may determine start/end of the heating mode and start/end of the cooling mode by a plurality of temperatures T2, T3, T5 and T6 set based on a heating target temperature T1 and a cooling target temperature T4.

The heating target temperature T1 may be a wine chamber target temperature in the heating mode. The cooling target temperature T4 may be a wine chamber target temperature in the cooling mode. The heating target temperature T1 may be different from the cooling target temperature T4. The heating target temperature T1 may be lower than the cooling target temperature T4 by a set temperature (e.g., 0.2° C. to 1° C.).

The plurality of temperature T2, T3, T5 and T6 may include an upper-limit target temperature T2, a heating termination temperature T3, a lower-limit target temperature T5 and a cooling termination temperature T6.

Hereinafter, the upper-limit target temperature T2 and the heating termination temperature T3 will be first described.

The upper-limit target temperature T2 may be a temperature for determining whether a timer 230 is reset or not in the heating mode. The upper-limit target temperature T2 may be set higher than the heating target temperature T1.

The controller 220 may compare the temperature T periodically sensed by the wine chamber temperature sensors and 79 with the upper-limit target temperature T2 and reset the timer 230 when the temperature T sensed by the wind chamber temperature sensors 69 and 79 is equal to or less than the upper-limit target temperature T2, after the heating mode starts.

The heating termination temperature T3 may be set to determine whether the heating mode terminates or not. The heating termination temperature t3 may be set higher than the upper-limit target temperature T2. The heating termination temperature T3 may be a temperature set higher than the upper-limit target temperature T2 by a predetermined temperature. For example, the heating termination temperature T3 may be higher than the upper-limit target temperature T2 by 1° C. to 2° C.

The upper-limit target temperature T2 may be set based on the heating target temperature T1, and the heating termination temperature T3 may be set based on the heating target temperature T1 or the upper-limit target temperature T2.

A difference (e.g., 1.5° C.) between the heating termination temperature T3 and the upper-limit target temperature T2 may be greater than a difference (e.g., 0.5° C.) between the upper-limit target temperature T2 and the heating target temperature T1.

If the heating termination temperature T3 is set too low, the heating mode may terminate in a state in which the wine chambers W1 and W2 are not sufficiently heated, and thus the heating termination temperature T3 has an appropriate temperature difference with the upper-limit target temperature T2 and is preferably set higher than the upper-limit target temperature T2.

For example, if the upper-limit target temperature T2 is set higher than the heating target temperature T1 by 0.5° C., the heating termination temperature T3 may be set higher than the upper-limit target temperature T2 by 1.5° C.

Hereinafter, the lower-limit target temperature T5 and the cooling termination temperature T6 will be described.

The lower-limit target temperature T5 may be a temperature for determining whether the timer 230 is reset in the cooling mode. The lower-limit target temperature T5 may be set lower than the cooling target temperature T4.

The controller 220 may compare the temperature T periodically sensed by the wine chamber temperature sensors and 79 with the lower-limit target temperature T5 and reset the timer 230 if the temperature T sensed by the wine chamber temperature sensors 69 and 79 is equal to or greater than the lower-limit target temperature T5, after the cooling mode starts.

The cooling termination temperature T6 may be set to determine whether the cooling mode terminates or not. The cooling termination temperature T6 may be set lower than the lower-limit target temperature T5. The cooling termination temperature T6 may be set lower than the lower-limit target temperature T5 by a predetermined temperature. For example, the cooling termination temperature T6 may be lower than the lower-limit target temperature T5 by 2° C. to 3° C.

The lower-limit target temperature T5 may be set based on the cooling target temperature T4, and the cooling termination temperature T6 may be set based on the cooling target temperature T4 or the lower-limit target temperature T5.

A difference (e.g., 2.5° C.) between the lower-limit target temperature T5 and the cooling termination temperature T6 may be greater than a difference (e.g., 0.5° C.) between the cooling target temperature T4 and the lower-limit target temperature T5.

If the cooling termination temperature T6 is set too high, the cooling mode may terminate in a state in which the wine chambers W1 and W2 are not sufficiently cooled, and thus the cooling termination temperature T6 has an appropriate temperature difference with the lower-limit target temperature T5 and is preferably set lower than the lower-limit target temperature T5.

For example, if the lower-limit target temperature T5 is set lower than the cooling target temperature T4 by 0.5° C., the cooling termination temperature T6 may be set lower than the lower-limit target temperature T5 by 2.5° C.

Meanwhile, the difference (e.g., 1.5° C.) between the heating termination temperature T3 and the upper-limit target temperature T2 may be less than the difference (e.g., 2.5° C.) between the lower-limit target temperature T5 and the cooling termination temperature T6. Since the quality of food such as wine may deteriorate when the temperature rapidly increases, the heating termination temperature T3 is not set to a predetermined temperature more than the cooling termination temperature T6.

Figure 7:
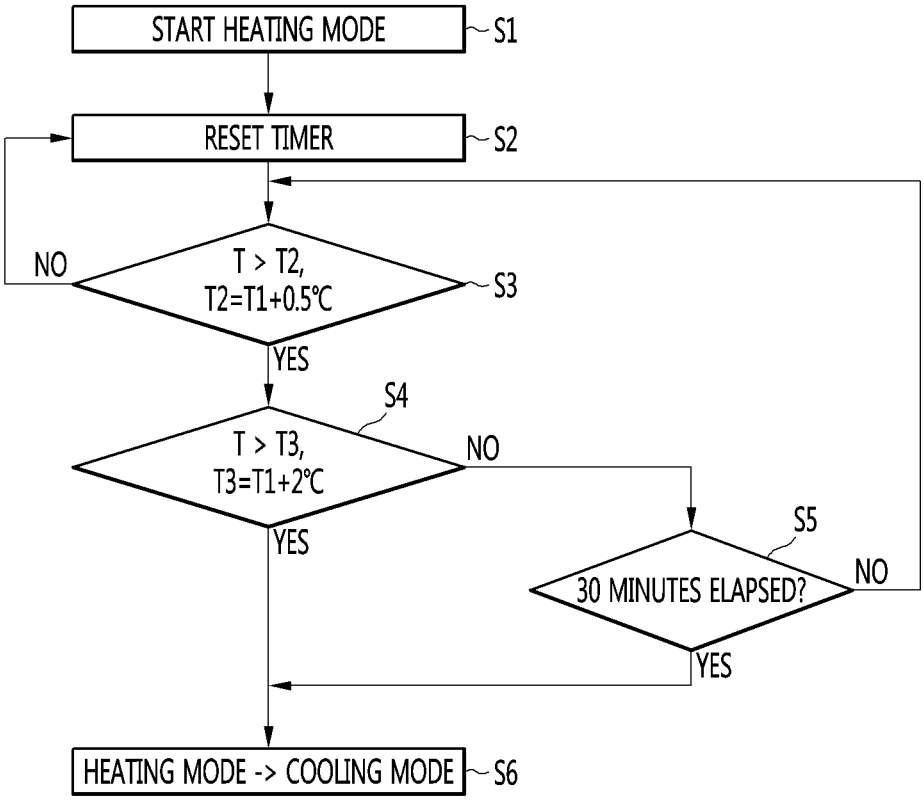
FIG. 7 is a flowchart illustrating a process of switching the wine chamber of the refrigerator according to the embodiment of the present disclosure from a heating mode to a cooling mode.

Hereinafter, the heating mode will be described with reference to FIG. 7.

When the heating mode starts, the controller 220 may turn on the wine chamber heaters 68 and 78 in order to heat the wine chambers W1 and W2. In addition, the controller 220 may drive the wine chamber fans 64 and 74. The controller 220 may independently heat the plurality of wine chambers W1 and W2.

In the heating mode of the first wine chamber W1, the first wine chamber heater 68 may be turned on and the first wine chamber fan 64 may be turned on. In addition, in the heating mode of the second wine chamber W2, the second wine chamber heater 78 may be turned on and the second wine chamber fan 74 may be turned on.

In the heating mode, the air of the wine chambers W1 and W2 may be circulated in the wine chamber heaters 68 and 78 and the wine chambers W1 and W2, and the wine chambers W1 and W2 may be gradually heated.

The refrigerator may further include the timer 230 for counting time, and the timer 230 may start to count the time when the heating mode starts. The timer 230 may count the time until the timer 230 is reset by the controller 220 and count the time again after the timer 230 is reset. The controller 220 may reset the timer 230 when the heating mode starts and the timer 230 may start to count the time when the timer is reset by the controller 220 (S1 and S2).

The controller 220 may reset the timer if the temperature sensed by the wine chamber temperature sensors 69 and 79 is equal to or less than the upper-limit target temperature T2 in the heating mode (S2 and S3).

The controller 220 may start the cooling mode if the temperature T sensed by the wine chamber temperature sensors and 79 is greater than the heating termination temperature T3 after the heating mode starts (S4 and S6).

That is, the controller 220 may switch the wine chambers W1 and W2 from the heating mode to the cooling mode if the temperature T sensed by the wine chamber temperature sensors 69 and 79 is greater than the heating termination temperature T3. The refrigerator may terminate the heating mode and perform the cooling mode if the temperatures of the wine chambers W1 and W2 exceed the heating termination temperature T3, after the heating mode starts (S4 and S6).

Meanwhile, in the refrigerator, the wine chambers W1 and W2 may not be greater than the heating termination temperature T3 and may be lower than the heating termination temperature T3, after the heating mode starts. After the heating mode starts, the temperatures of the wine chambers W1 and W2 may be maintained between the upper-limit target temperature T2 and the heating termination temperature T3 for a long time. In this case, the wine chambers W1 and W2 are heated for a long time in a temperature range higher than the heating target temperature T1, and heating of the wine chambers W1 and W2 for the long time may deteriorate the quality of food and, more particularly, wine.

After the heating mode starts, when the temperatures of the wine chambers W1 and W2 are maintained between the upper-limit target temperature T2 and the heating termination temperature T3 for the long time, the controller 220 may forcibly terminate the heating mode even if the temperatures of the wine chambers W1 and W2 do not exceed the heating termination temperature T3 (S3, S4, S5 and S6).

That is, the controller 220 may determine forced termination of the heating mode according to the time when the temperature of the wine chamber is greater than the upper-limit target temperature T2 and is equal to or less than the heating termination temperature T3, after the heating mode starts.

The controller 220 may start the cooling mode if the time when the temperature sensed by the wine chamber temperature sensors 69 and 79 is greater than the upper-limit target temperature T2 and is equal to or less than the heating termination temperature T3 exceeds a heating setting time ST1, after the heating mode starts (S3, S4, S5 and S6).

The heating setting time ST1 may be set to determine whether the heating mode forcibly terminates.

The heating setting time ST1 may be at least 20 minutes and may be set to a predetermined time such as 30 minutes or 40 minutes. The heating setting time ST1 may be set to a minimum of 20 minutes or a maximum of 120 minutes. An example of the heating setting time ST1 may be 30 minutes.

The controller 220 may forcibly terminate the heating mode when the temperature sensed by the wine chamber temperature sensors 69 and 79 is greater than the upper-limit target temperature T2 and is equal to or less than the heating termination temperature T3 until the time counted in the timer 230 reaches the heating setting time ST1, and perform the cooling mode in order to cool the wine chambers W1 and W2 (S3, S4, S5 and S6).

The controller 220 may start the cooling mode when the time counted in the timer 230 exceeds the heating setting time ST1.

That is, the controller 220 may immediately terminate the heating mode (S4 and S6) if the temperatures of the wine chambers W1 and W2 are the heating termination temperature T3 after the heating mode starts, and forcibly terminate the heating mode if the temperatures of the wine chambers W1 and W2 are greater than the upper-limit target temperature T2 and are equal to or less than the heating termination temperature T3 during the heating setting time ST1 after the heating mode starts, exceeds the heating setting time ST1 even if the temperatures of the wine chambers W1 and W2 do not reach the heating termination temperature T3 (S3, S4, S5 and S6).

In control of the controller 220, it is possible to minimize heating of the wine chambers W1 and W2 to a temperature higher than the heating termination temperature T3 and to prevent the wine chambers W1 and W2 from being continuously heated in a temperature range greater than the upper-limit target temperature T2 and equal to or less than the heating termination temperature T3.

When the heating mode terminates, the controller 220 may turn off the wine chamber heaters 68 and 78.

Meanwhile, the controller 220 may drive the compressor 1, control the valve 10 to the storage chamber evaporator supply mode as shown in FIG. 5, and drive the storage chamber fan 84, when the temperature sensed by the storage chamber temperature sensor 89 is equal to or greater than a storage chamber upper-limit target temperature in the heating mode, that is, the heating mode of the wine chambers W1 and W2. The controller 220 may turn off the compressor 1 and stop the storage chamber fan 84, when the temperature sensed by the storage chamber temperature sensor 89 is equal to or less than the storage chamber lower-limit target temperature in the heating mode of the wine chamber.

That is, in the refrigerator, the storage chamber F may be cooled while the wine chambers W1 and W2 are heated. If the temperature of the storage chamber F is decreased to the storage chamber lower-limit target temperature or less while the heating mode of the wine chambers W1 and w2 continues, cooling of the storage chamber F may be stopped.

Hereinafter, the cooling mode will be described with reference to FIG. 8.

When the cooling mode starts, the controller 220 may drive the compressor 1 in order to cool the wine chambers W1 and W2. In addition, the controller 220 may control the valve 10 to the wine chamber evaporator supply mode as shown in FIG. 4. In addition, the controller 220 may drive the wine chamber fans 64 and 74. The controller 220 may independently heat the plurality of wine chambers W1 and W2.

If the first wine chamber W1 and the second wine chamber W2 are in the cooling mode, the controller 220 may control the valve 10 to a second wine chamber supply mode and drive the first wine chamber fan 64 and the second wine chamber fan 74.

If only the first wine chamber W1 is in the cooling mode, the controller 220 may control the valve 10 to a first wine chamber supply mode, may drive the first wine chamber fan 64 and may not the second wine chamber fan 74.

In the cooling mode, air of the wine chambers W1 and W2 may be circulated in the wine chamber evaporators 6 and 7 and the wine chambers W1 and W2, the wine chambers W1 and W2 may be gradually cooled.

The timer 230 may start to count the time when the cooling mode starts. The timer 230 may count the time until the timer 230 is reset by the controller 220 and count the time again after the timer 230 is reset. The controller 220 may reset the timer 230 when the cooling mode starts and the timer 230 may start to count the time when the timer is reset by the controller 220 (S6 and S7).

The controller 220 may reset the timer if the temperature sensed by the wine chamber temperature sensors 69 and 79 is equal to or greater than the lower-limit target temperature T5 in the cooling mode (S7 and S8).

The controller 220 may start the heating mode if the temperature T sensed by the wine chamber temperature sensors 69 and 79 is less than the cooling termination temperature T6 after the cooling mode starts (S9 and S1). That is, the controller 220 may switch the wine chambers W1 and W2 from the cooling mode to the heating mode if the temperature T sensed by the wine chamber temperature sensors 69 and 79 is less than the cooling termination temperature T6. The refrigerator may terminate the cooling mode and perform the heating mode if the temperatures of the wine chambers W1 and W2 are less than the cooling termination temperature T6, after the cooling mode starts (S9 and S1).

Meanwhile, in the refrigerator, the temperatures of the wine chambers W1 and W2 are not lower than the cooling termination temperature 63 and are higher than the cooling termination temperature T6, after the cooling mode starts. After the cooling mode starts, the temperatures of the wine chambers W1 and W2 may be maintained between the lower-limit target temperature T5 and the cooling termination temperature T6 for a long time. In this case, the wine chambers W1 and W2 are cooled for a long time in a temperature range lower than the cooling target temperature T4, and cooling of the wine chambers W1 and W2 for the long time may deteriorate the quality of food and, more particularly, wine.

After the cooling mode starts, when the temperatures of the wine chambers W1 and W2 are maintained between the lower-limit target temperature T5 and the cooling termination temperature T6 for the long time, the controller 220 may forcibly terminate the cooling mode even if the temperatures of the wine chambers W1 and W2 are not less than the cooling termination temperature T6 (S8, S9, S10 and S1).

That is, the controller 220 may determine forced termination of the cooling mode according to the time when the temperature of the wine chamber is less than the lower-limit target temperature T5 and is equal to or greater than the cooling termination temperature T6, after the cooling mode starts.

The controller 220 may start the heating mode if the time when the temperature sensed by the wine chamber temperature sensors 69 and 79 is less than the lower-limit target temperature T5 and is equal to or greater than the cooling termination temperature T6 exceeds a cooling setting time ST2, after the cooling mode starts (S8, S9, S10 and S1).

The heating setting time ST2 may be set to determine whether the cooling mode forcibly terminates.

The cooling setting time ST2 may be set to be equal to the heating setting time ST1. The cooling setting time ST2 may be at least 20 minutes and may be set to a predetermined time such as 30 minutes or 40 minutes. The cooling setting time ST2 may be set to a minimum of 20 minutes or a maximum of 120 minutes. An example of the cooling setting time ST2 may be 30 minutes.

The controller 220 may forcibly terminate the cooling mode when the temperature sensed by the wine chamber temperature sensors 69 and 79 is less than the lower-limit target temperature T5 and is equal to or greater than the cooling termination temperature T6 until the time counted in the timer 230 reaches the cooling setting time ST2, and perform the heating mode in order to heat the wine chambers W1 and W2 (S8, S9, S10 and S1).

The controller 220 may start the heating mode when the time counted in the timer 230 exceeds the cooling setting time ST2.

That is, the controller 220 may immediately terminate the cooling mode (S9 and S1) if the temperatures of the wine chambers W1 and W2 are the cooling termination temperature T6 after the cooling mode starts, and forcibly terminate the cooling mode if the temperatures of the wine chambers W1 and W2 are less than the lower-limit target temperature T2 and are equal to or greater than the cooling termination temperature T6 during the cooling setting time ST2 after the heating mode starts, exceeds the cooling setting time ST2 even if the temperatures of the wine chambers W1 and W2 do not become less than the cooling termination temperature T6 (S9, S10 and S1).

In control of the controller 220, it is possible to minimize cooling of the wine chambers W1 and W2 to a temperature lower than the cooling termination temperature T6 and to prevent the wine chambers W1 and W2 from being continuously cooled in a temperature range less than the lower-limit target temperature T5 and equal to or greater than the cooling termination temperature T6.

Meanwhile, according to an embodiment of the present disclosure, it is possible to cool or heat the wine chamber based on one wine chamber target temperature and to set one wine chamber target temperature without differently setting the cooling target temperature and the heating target temperature. In this case, the upper-limit target temperature T2 may be higher than the wine chamber target temperature by a first temperature (e.g., 0.5° C.) and the lower-limit target temperature T5 may be lower than the wine chamber target temperature by a second temperature (e.g., 0.5° C.)

In addition, the heating termination temperature may be set to a temperature higher than the wine chamber target temperature by a third temperature (e.g., 2° C.) and the cooling termination temperature may be lower than the wine chamber target temperature by a fourth temperature (e.g., 3° C.)

According to embodiments, it is possible to prevent the wine chamber from being heated for a long time and to minimize quality deterioration of food such as wine when the wine chamber is heated for the long time.

In addition, it is possible to prevent the wine chamber from being cooled for a long time and to minimize quality deterioration of food such as wine when the wine chamber is cooled for the long time.

In addition, in the heating mode, since refrigerant is not supplied to the wine chamber evaporator, it is possible to maintain the wine chamber at a constant temperature while minimizing power consumption.

The above-disclosed subject matter is to be considered illustrative, and not restrictive, and the appended claims are intended to cover all such modifications, enhancements, and other embodiments, which fall within the scope of the present disclosure.

Thus, the embodiment of the present disclosure is to be considered illustrative, and not restrictive.

Therefore, the scope of the appended claims is defined not by the detailed description of the disclosure but by the appended claims, and all differences within the scope will be construed as being included in the appended claims.

What is claimed is:

1. A refrigerator comprising:
a wine chamber;
a wine chamber evaporator to cool the wine chamber;
a compressor connected with the wine chamber evaporator;
a wine chamber heater to heat the wine chamber;
a valve to regulate refrigerant flowing to the wine chamber evaporator;
a wine chamber temperature sensor to sense a temperature of the wine chamber; and
a controller to control the compressor, the wine chamber heater and the valve,
wherein the controller selectively performs:
a cooling mode in which the controller drives the compressor and regulates the valve to allow the refrigerant to flow to the wine chamber evaporator, and
a heating mode in which the controller drives the wine chamber heater, and regulates the valve to prevent the refrigerant from being supplied to the wine chamber evaporator.

2. The refrigerator of claim 1, further comprising a wine chamber fan, wherein the controller:
drives the wine chamber fan in the cooling mode to circulate air of the wine chamber to the wine chamber evaporator, and
drives the wine chamber fan in the heating mode to circulate air of the wine chamber to the wine chamber heater.

3. The refrigerator of claim 1,
wherein the controller:
starts the cooling mode when a temperature sensed by the wine chamber temperature sensor is greater than a heating termination temperature which is higher than an upper-limit target temperature, after the heating mode starts.

4. The refrigerator of claim 3, further comprising
a timer,
wherein the controller:
starts the cooling mode when time counted by the timer exceeds a heating setting time after the heating mode starts where, during the heating setting time, the temperature sensed by the wine chamber temperature sensor is greater than the upper-limit target temperature and is equal to or less than the heating termination temperature.

5. The refrigerator of claim 4, wherein, in the heating mode, the controller:
periodically compares the temperature sensed by the wine chamber temperature sensor with the upper-limit target temperature, and resets the timer when the temperature sensed by the wine chamber temperature sensor is equal to or less than the upper-limit target temperature.

6. The refrigerator of claim 4,
wherein the heating termination temperature is higher than the upper target temperature by 1° C. to 2° C., and
wherein the heating setting time is at least 20 minutes.

7. The refrigerator of claim 3, wherein the controller:
starts the heating mode when the temperature sensed by the wine chamber temperature sensor is less than a cooling termination temperature which is lower than a lower-limit target temperature, after the cooling mode starts.

8. The refrigerator of claim 7, further comprising a timer, wherein the controller:
starts the heating mode when time counted by the timer exceeds a cooling setting time after the cooling mode starts where, during the cooling setting time, the temperature sensed by the wine chamber temperature sensor is less than the lower-limit target temperature and is equal to or greater than the cooling termination temperature.

9. The refrigerator of claim 8, wherein, in the cooling mode, the controller:
periodically compares the temperature sensed by the wine chamber temperature sensor with the lower-limit target temperature, and resets the timer when the temperature sensed by the wine chamber temperature sensor is equal to or greater than the lower-limit target temperature.

10. The refrigerator of claim 8,
wherein the cooling termination temperature is lower than the lower-limit target temperature by 2° C. to 3° C., and
wherein the cooling setting time is at least 20 minutes.

11. The refrigerator of claim 7, wherein a difference between the heating termination temperature and the upper-limit target temperature is less than a difference between the lower-limit target temperature and the cooling termination temperature.

12. A refrigerator comprising:
a wine chamber;
a storage chamber;
a wine chamber evaporator to cool the wine chamber;
a storage chamber evaporator to cool the storage chamber;
a compressor connected with the wine chamber evaporator and the storage chamber evaporator;
a wine chamber heater to heat the wine chamber;
a valve to regulate refrigerant flowing to the wine chamber evaporator and the storage chamber evaporator;
a wine chamber temperature sensor to sense a temperature of the wine chamber;
a storage chamber temperature sensor to sense a temperature of the storage chamber; and
a controller to control the compressor, the wine chamber heater and the valve,
wherein the controller selectively performs:
a cooling mode of the wine chamber in which the controller drives the compressor and regulates the valve to allow the refrigerant to flow to the wine chamber evaporator and prevent the refrigerant to flow to the storage chamber evaporator,
a heating mode of the wine chamber in which the controller drives the wine chamber heater and regulates the valve to prevent the refrigerant from being supplied to the wine chamber evaporator.

13. The refrigerator of claim 12,
wherein the controller:
starts the cooling mode of the wine chamber when a temperature sensed by the wine chamber temperature sensor is greater than a heating termination temperature which is higher than an upper-limit target temperature, after the heating mode starts, and
starts the cooling mode of the wine chamber when time exceeds a heating setting time after the heating mode of the wine chamber starts where, during the heating mode, the temperature sensed by the wine chamber temperature sensor is greater than the upper-limit target temperature and is equal to or less than the heating termination temperature.

14. The refrigerator of claim 13, further comprising a timer, wherein, in the heating mode of the wine chamber, the controller:

periodically compares the temperature sensed by the wine chamber temperature sensor with the upper-limit target temperature, and resets the timer when the temperature sensed by the wine chamber temperature sensor is equal to or less than the upper-limit target temperature.

15. The refrigerator of claim 13, wherein the controller:

starts the heating mode of the wine chamber when the temperature sensed by the wine chamber temperature sensor is less than a cooling termination temperature which is lower than a lower-limit target temperature, after the cooling mode of the wine chamber starts, and starts the heating mode of the wine chamber when time exceeds a cooling setting time after the cooling mode of the wine chamber starts where, during the cooling mode, the temperature sensed by the wine chamber temperature sensor is less than the lower-limit target temperature and is equal to or greater than the cooling termination temperature.

16. The refrigerator of claim 15, further comprising a timer, wherein, in the cooling mode of the wine chamber, the controller:

periodically compares the temperature sensed by the wine chamber temperature sensor with the lower-limit target temperature, and resets the timer when the temperature sensed by the wine chamber temperature sensor is equal to or greater than the lower-limit target temperature.

17. The refrigerator of claim 15, wherein a difference between the heating termination temperature and the upper-limit target temperature is less than a difference between the lower-limit target temperature and the cooling termination temperature.

18. The refrigerator of claim 12, wherein the controller performs a cooling mode of the storage chamber while performing the heating mode of the wine chamber, in which the controller drives the compressor, drives the wine chamber heater and regulates the valve to allow the refrigerant to flow to the storage chamber evaporator and prevent the refrigerant to flow to the wine chamber evaporator.

19. The refrigerator of claim 18, wherein the controller drives the compressor in the cooling mode of the storage chamber when the temperature sensed by the storage chamber temperature sensor is equal to or greater than a storage chamber upper-limit target temperature while in the heating mode of the wine chamber.

20. The refrigerator of claim 18, wherein the controller turns off the compressor if the temperature sensed by the storage chamber temperature sensor is equal to or less than a storage chamber lower-limit target temperature while in the heating mode of the wine chamber.

* * * * *